US006862850B2

(12) United States Patent
Berger, Jr.

(10) Patent No.: US 6,862,850 B2
(45) Date of Patent: Mar. 8, 2005

(54) WINDOW ASSEMBLY FOR OPENING CLOSURES

(75) Inventor: Allen Berger, Jr., Hialeah Gardens, FL (US)

(73) Assignee: DAB Door Company, Inc., Hialeah, FL (US)

( * ) Notice: Subject to any disclaimer, the term of this patent is extended or adjusted under 35 U.S.C. 154(b) by 0 days.

(21) Appl. No.: 10/847,021

(22) Filed: May 18, 2004

(65) Prior Publication Data

US 2004/0211133 A1 Oct. 28, 2004

Related U.S. Application Data

(63) Continuation of application No. 10/201,762, filed on Jul. 23, 2002, now Pat. No. 6,763,638.

(51) Int. Cl.[7] ..... E06B 9/01

(52) U.S. Cl. ..... 52/204.6; 52/204.62; 52/204.5; 52/204.593

(58) Field of Search ..... 52/204.6, 204.62, 52/204.5, 204.593, 288, 204.591, 591, 455; 40/735, 765, 768

(56) References Cited

U.S. PATENT DOCUMENTS 3,813,799 A * 6/1974 Caravello ..... 40/735
4,407,100 A * 10/1983 Huelsekopf ..... 52/204.54
5,040,347 A * 8/1991 Valvis ..... 52/204.591
5,105,567 A * 4/1992 Real ..... 40/765
5,133,168 A * 7/1992 Neilly et al. ..... 52/204.5
5,581,970 A * 12/1996 O'Shea ..... 52/718.01
5,765,325 A * 6/1998 DeBlock ..... 52/204.5
5,845,425 A * 12/1998 Leake et al. ..... 40/725
6,105,288 A * 8/2000 Becker ..... 40/124.5
6,272,801 B1 * 8/2001 Suh ..... 52/211
6,553,735 B1 * 4/2003 Wang Chen ..... 52/455
6,647,677 B1 * 11/2003 Berger, Jr. ..... 52/204.1

* cited by examiner

*Primary Examiner*—Carl D. Friedman
*Assistant Examiner*—Nahid Amiri
(74) *Attorney, Agent, or Firm*—J. Sanchelima; A. Bordas

(57) ABSTRACT

A window assembly for garage door panels. The assembly includes an outer frame assembly that overlaps the panel opening to be protected and it is mounted thereon. An inner frame assembly co-axially extends from the outer frame assembly and jointly define a window area. A longitudinal slot along one of the elongated members defining the inner frame assembly permits a user to removably mount a transparent member therein. Ornamental frame assemblies can be optionally mounted over the present invention to enhance the aesthetics of the resulting structure. An alternate embodiment includes a second transparent member positioned within the outer frame assembly through another elongated slot in one of the elongated frame members. Internal channels in the frame members bite into the edges of the transparent members.

5 Claims, 8 Drawing Sheets

WINDOW ASSEMBLY FOR OPENING CLOSURES

OTHER RELATED APPLICATIONS

The present application is a continuation application of the pending and allowed U.S. patent application Ser. No. 10/201,762 filed on Jul. 23, 2002, now U.S Pat. No. 6,763,638, which is hereby indorporated by reference.

II. BACKGROUND OF THE INVENTION

1. Field of the Invention

The present invention relates to a window assembly for opening closures and more particularly, for doors and windows.

2. Description of the Related Art

Window assemblies are typically mounted on panels. They are designed to enhance the aesthetic appeal of the closures (doors) while permitting daylight to go through. However, the window assemblies used in conventional garage doors include frames that cannot withstand high winds, such as those that develop in certain areas, such as South Florida. Local construction codes include wind tests that require reinforcement of these window assemblies and many times these added structures detract from the aesthetics of the window design. Garage doors, for instance, typically include a number of hingedly connected panels that are moved from a vertical position to a horizontal overhead position over tracks. The conventional window assemblies in these doors fail to meet these tests. Thus, the desirability of a sturdier structure.

The advantages of the present invention, as it will be more fully explained in the following paragraphs, include a simple window assembly that can be readily installed around the edges of the aperture defining the window. The frame assembly includes a slot with cooperative dimensions to slidably receive a transparent panel. The assembly is thus capable of retaining the transparent panel while absorbing the impact energy of high winds and flying objects.

Applicant believes that the closest references correspond to U.S. patent application Ser. No. 10/073,642 filed on Feb. 11, 2002 by applicant for a window assembly for garage doors that can withstand high winds. However, it differs from the previous application because the present invention includes an outer T-shape frame assembly that can be readily installed through the aperture defining the window. This simpler frame assembly includes a longitudinal slot with cooperative dimensions that permits a user to slidably mount a transparent member therein. Ornamental frame assemblies can be optionally mounted over the frame assembly to enhance the aesthetics of the resulting structure.

III. SUMMARY OF THE INVENTION

It is one of the main objects of the present invention to provide a window assembly that can be readily mounted through an opening having cooperative dimensions.

It is another object of this invention to provide a window assembly that can withstand high wind loads.

It is still another object of the present invention to provide a window assembly where the transparent member can be readily replaced.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

V. DETAILED DESCRIPTION OF THE PREFERRED EMBODIMENT

Figure 1:
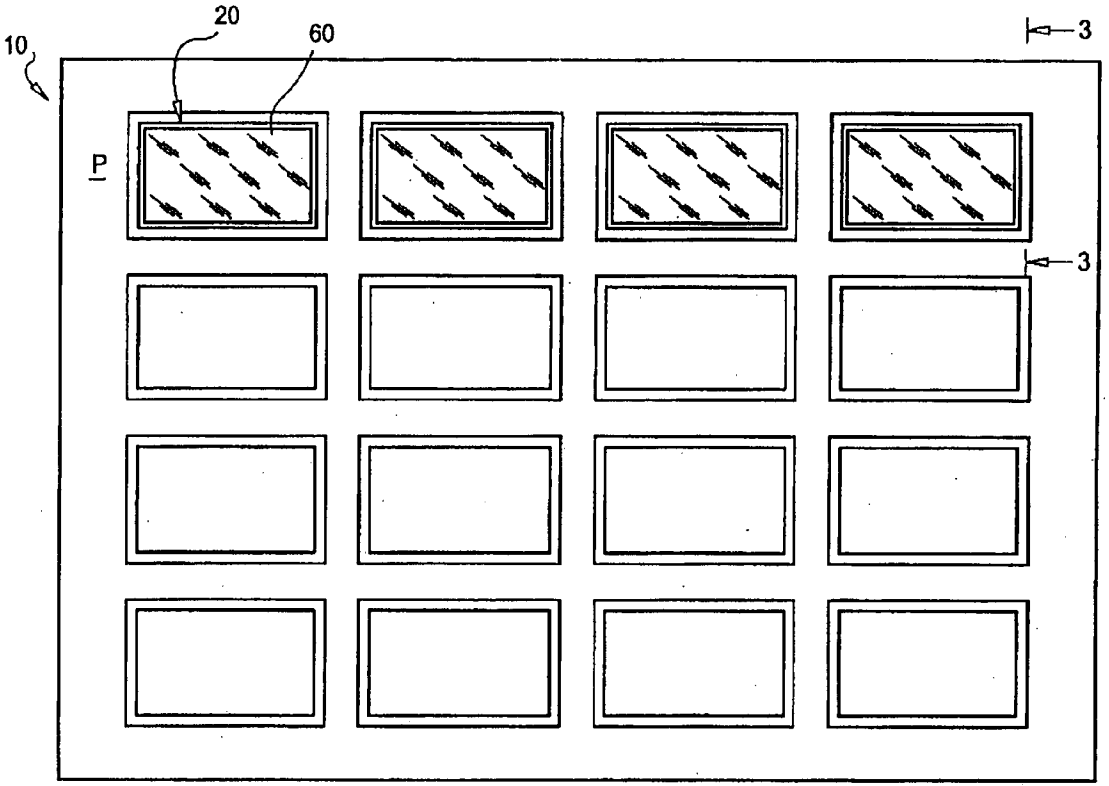
FIG. 1 represents a front elevational view of one of the preferred embodiments for the window assembly subject of the present application mounted to a garage door panel.
Figure 2:
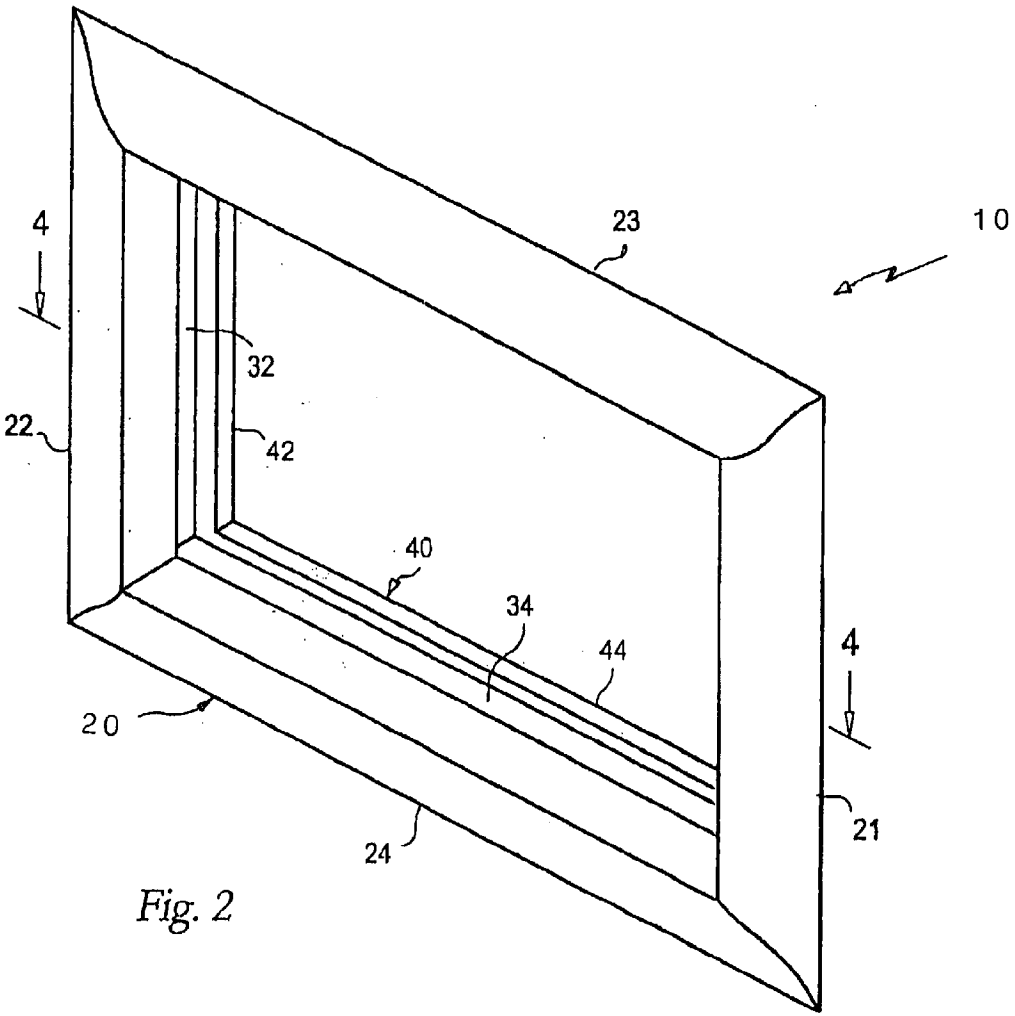
FIG. 2 shows an isometric view of the window assembly illustrated in the previous figure.
Figure 3:
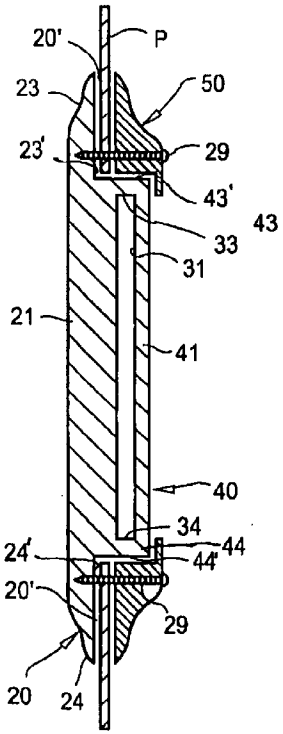
FIG. 3 illustrates a cross-sectional view taken along line 3—3 in FIG. 1.
Figure 4:
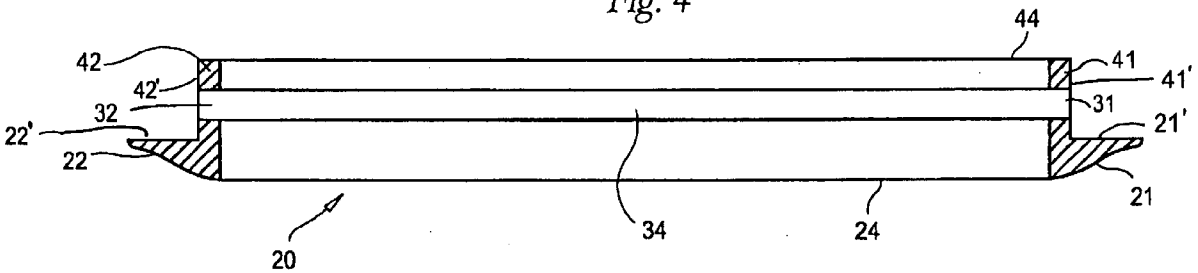
FIG. 4 illustrates a cross-sectional view taken along line 4—4 in FIG. 2.

Referring now to the drawings, where the present invention is generally referred to with numeral 10, it can be observed that it basically includes outer frame assembly 20 and inner frame assembly 40 co-axially and contiguously mounted thereon, (in the preferred embodiment they are integrally built), transparent member 60 removably housed within said inner frame member 40 and panel assembly P. Window assembly 10 is mounted through opening O, of panel assembly P, which has cooperative dimensions to receive the former, as seen in FIGS. 1 and 4.

Outer frame assembly 20 has a rectangular shape in the preferred embodiment shown in FIGS. 1 through 4. Elongated vertical frame members 21 and 22 are kept at a spaced apart and parallel relationship with respect to each other by perpendicularly mounted elongated horizontal members 23 and 24. Inner peripheral edges 21'; 22'; 23' and 24' are defined with members 21; 22; 23 and 24. Members 21; 22; 23 and 24 include one co-planar surface each that combined defines a common co-planar surface 20' that extend peripherally.

Inner frame assembly 40 includes elongated frame members 41; 42; 43 and 44. Members 41 and 42 are kept at a spaced apart and parallel relationship with respect to each other by perpendicularly mounted elongated members 43 and 44. Inner peripheral edges 41'; 42'; 43' and 44' are defined with members 41; 42; 43 and 44 respectively. Inner peripheral edges 41'; 42'; 43' and 44' are aligned with peripheral edges 21'; 22'; 23' and 24' to define window aperture 26. Frame member 41 includes longitudinal slot 31 and frame member 42 includes longitudinal slot 32, in the embodiment shown in FIGS. 2 and 3. Slot 32 is optional and a channel can substitute it provided it is deep enough to bite a sufficient edge portion of transparent member 60. The advantage of using a second slot 32 is that it provides versatility to a user who will then be able to insert transparent member 60 from either side. Elongated frame members 43 and 44 include elongated channels 33 and 34, respectively. Elongated channels 33 and 34 have cooperative dimensions to slidably and snuggly receive lateral ends 63 and 64 of transparent member 60.

Figure 5:
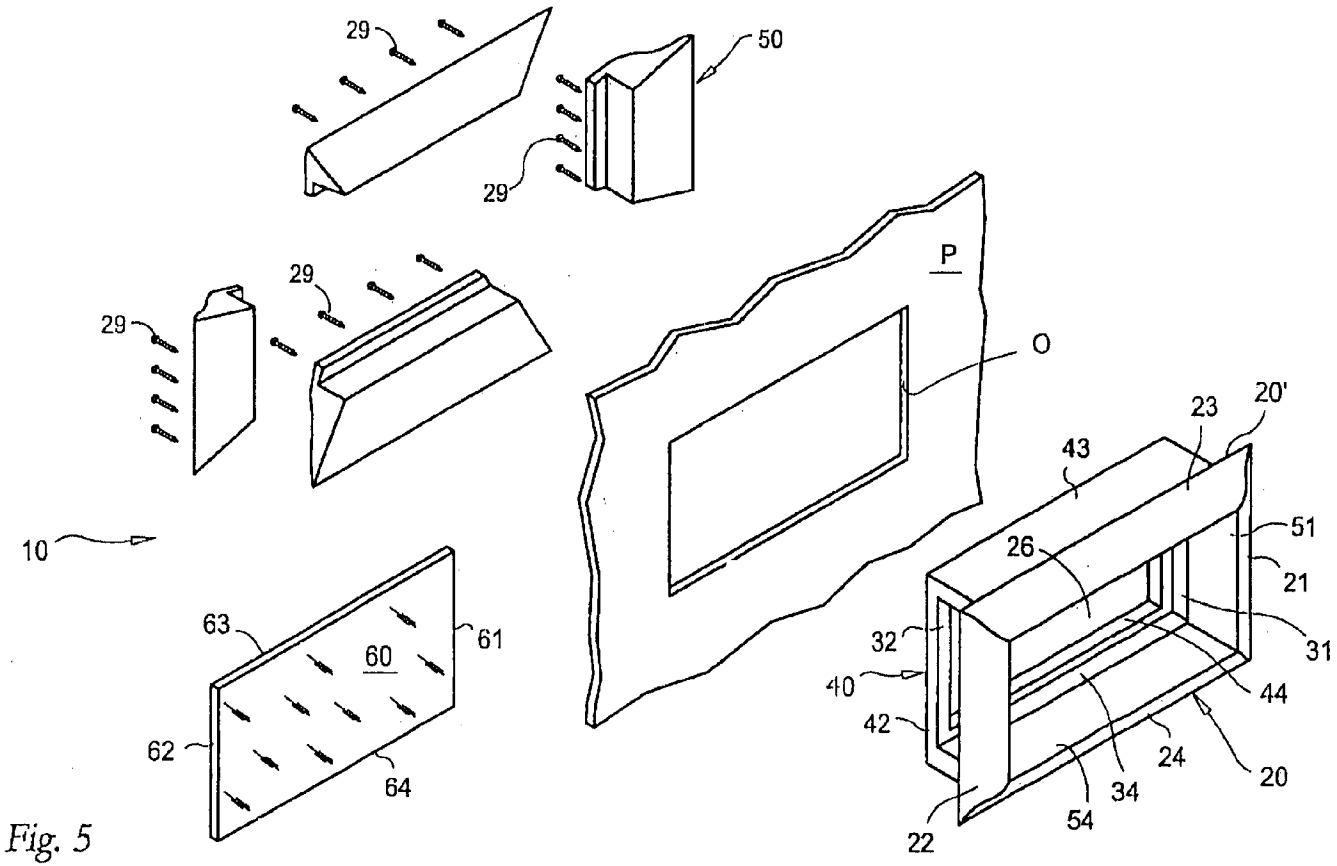
FIG. 5 is an exploded isometric representation of one of the preferred embodiments for the window assembly, object of the present invention.

Transparent member 60 includes lateral ends 61; 62; 63 and 64. Member 60 has cooperative dimensions to be mounted through longitudinal slot 31 (or 32). Also, member 60 has cooperative dimensions to cover window area aperture 26, as best seen in FIG. 5.

To mount window 10 on panel P, common coplanar surface 20' is brought against panel P at the area adjacent to the aperture where window 10 is going to be installed. A cementitious compound (epoxy or equivalent) can be used to keep outer frame assembly 20 attached to panel P. Fastening members (such as screws) 29 can optionally be used to further ensure the attachment to panel P.

A locking frame assembly 50 is mounted over inner frame assembly 40 to cover the latter, including slot 31 (and 32), to prevent the movement of transparent member 60. Assembly 50 can include ornamentary features to enhance the aesthetics of the resulting structure.

Figure 6:
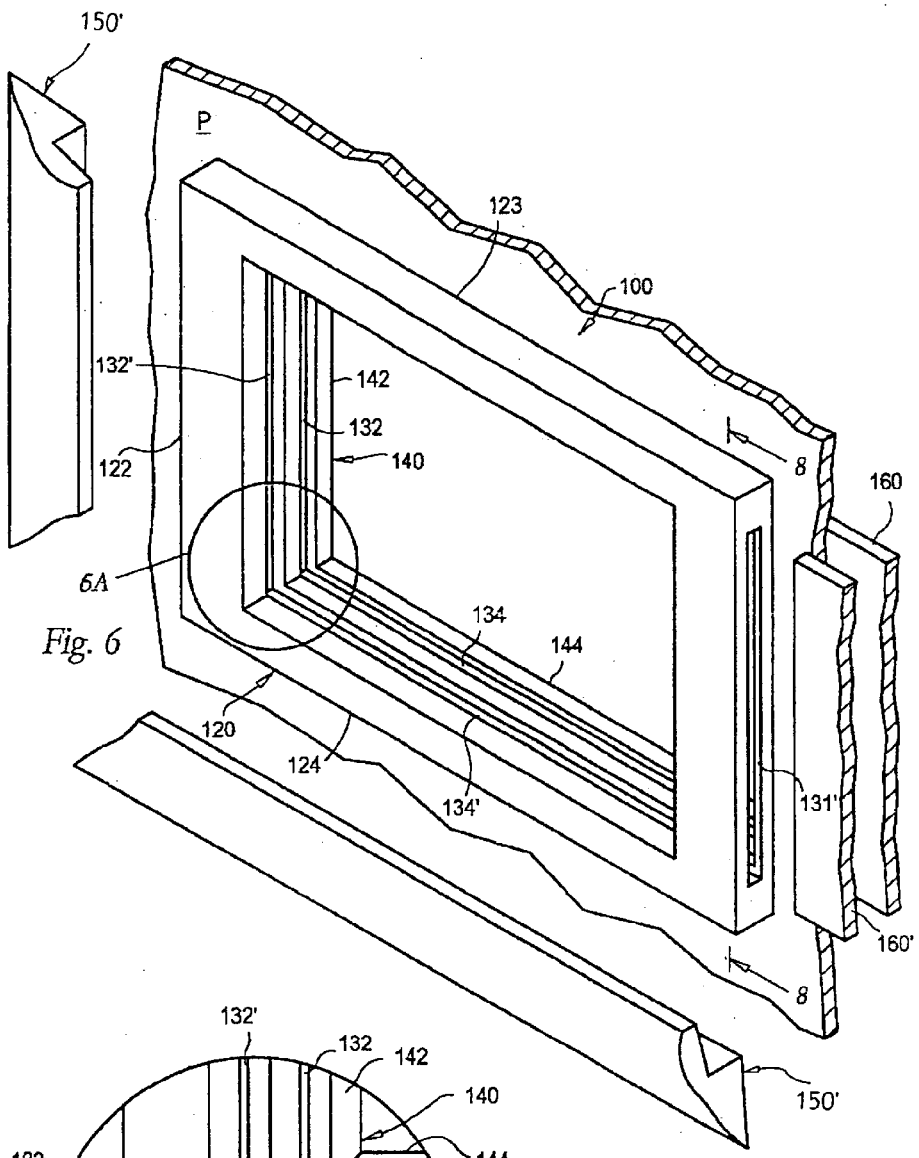
FIG. 6 shows an isometric view of another of preferred embodiments for the window assembly having two slots for insert transparent elements.
Figure 6A:
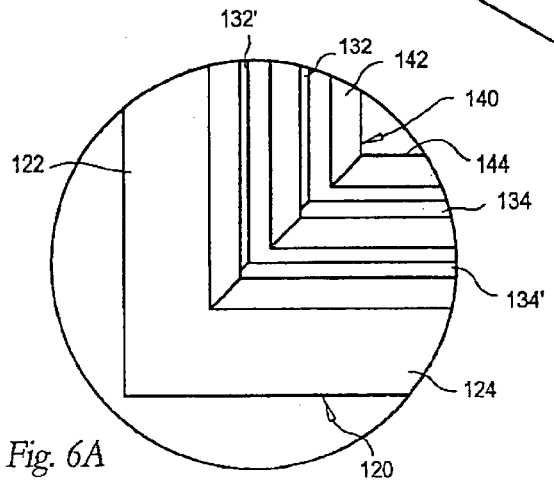
FIG. 6A is an enlarged detail view of one of the corners of the window assembly shown in FIG. 6.
Figures 7A, 7B, 7C:
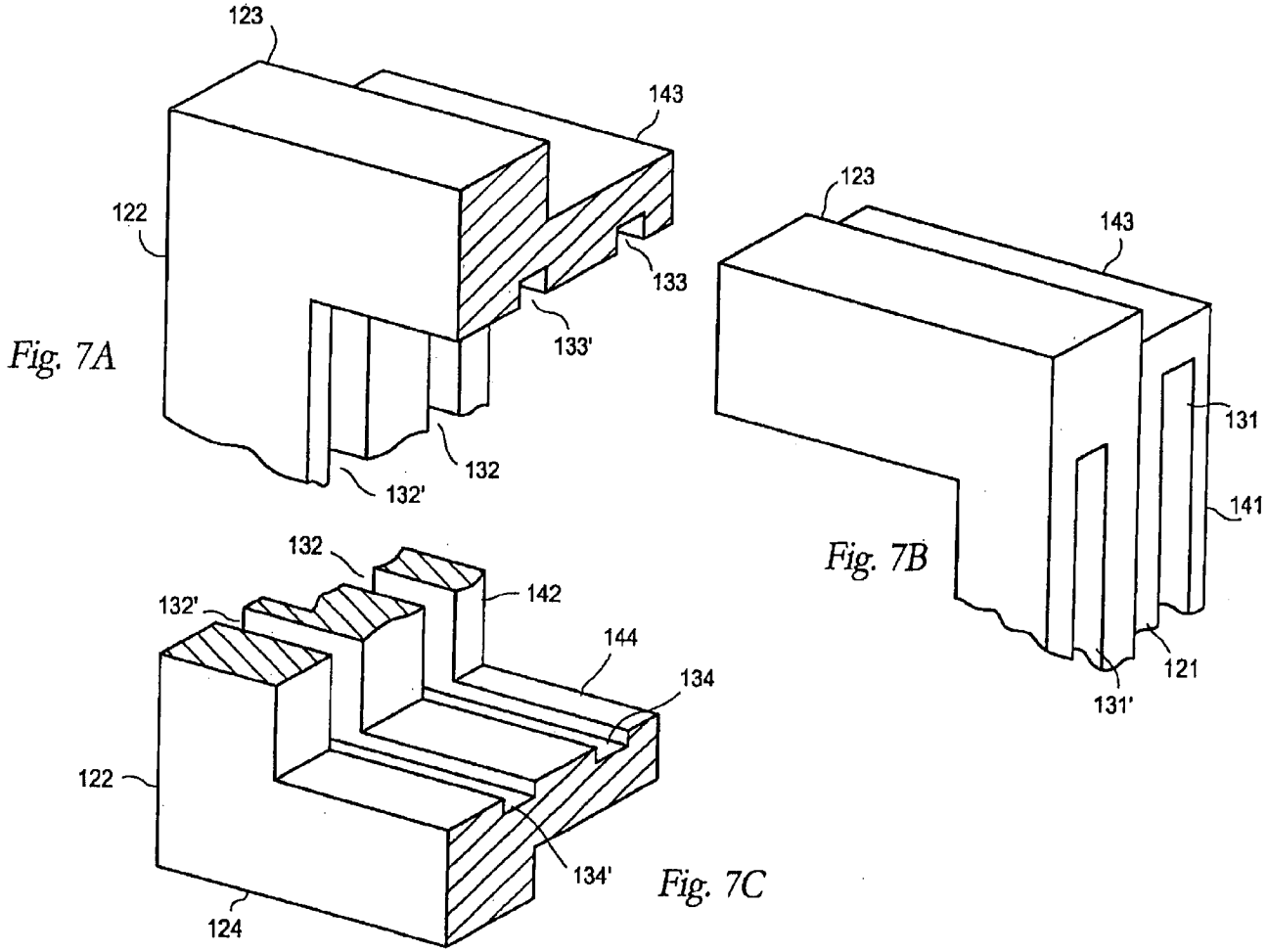
FIG. 7A shows a partial isometric view of one of the upper corners of the embodiment represented in FIG. 5.
FIG. 7B shows a partial isometric view of the other upper corner of the embodiment represented in FIG. 5.
FIG. 7C shows a partial isometric view of one of the lower corners of the embodiment represented in FIG. 6.

Another embodiment for the present invention is shown as window assembly 100, as illustrated in FIGS. 6; 7A; 7B, 7C and 8, basically includes outer frame assembly 120, inner frame assembly 140 and transparent members 160 and 160' removably housed within outer and inner frame member 120 and 140, respectively.

Window assembly 100 has substantially the same configuration as window assembly 10 including elongated member 121; 122; 123 and 124. Outer frame member 121 includes longitudinal slot 131'. Frame member 122 optionally includes longitudinal slot 132' to provide versatility. Members 121; 122; 123 and 124 combine to define a common co-planar surface 120'. Elongated frame members 123 and 124 include elongated channels 133' and 134', respectively. Elongated channels 133' and 134' have cooperative dimensions to slidably and snuggly receive the lateral ends of second transparent member 160'. This double glaze window assembly has better thermal and acoustic characteristics.

Inner frame assembly 140 includes member 141 with slot 131. Member 142 is similarly provided either a slot 132 or a channel for receiving an edge of transparent member 160.

Locking frame assembly 150 is mounted over inner frame assembly 140. Assembly 150 covers assembly 140 including slot 131 (and optional 132), thereby preventing the movement of transparent member 160. Locking frame assembly 150' is mounted over outer frame assembly 120. Assembly 150' covers assembly 120 including slot 131' (and optional 132'), thereby preventing the movement of transparent member 160'. Assemblies 150 and 150' can also include ornamentary features.

Figure 10:
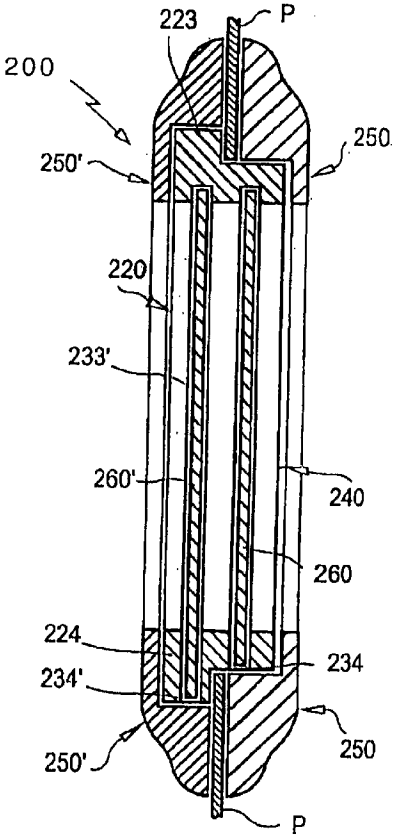
FIG. 10 illustrates a cross-sectional view taken along line 10—10 in FIG. 9.
Figure 9:
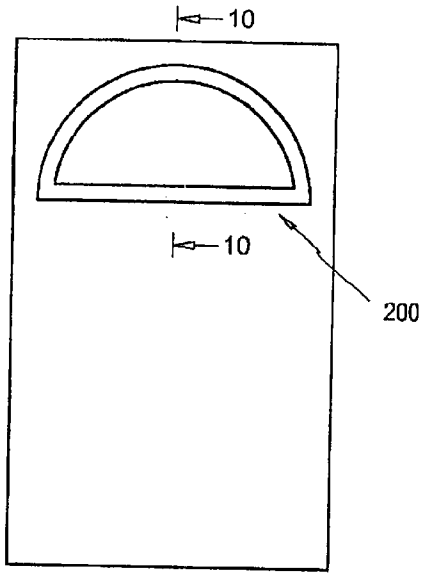
FIG. 9 represents a front elevational view of another of the preferred embodiments for window assembly mounted to a door.
Figure 8:
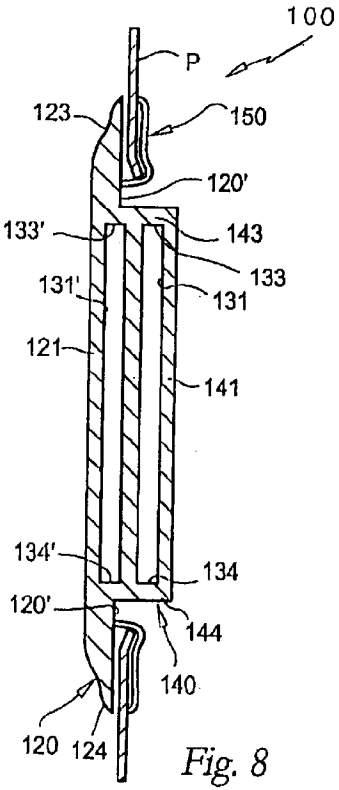
FIG. 8 illustrates a cross-sectional view taken along line 8—8 in FIG. 6.
Figures 11A, 11B, 11C:
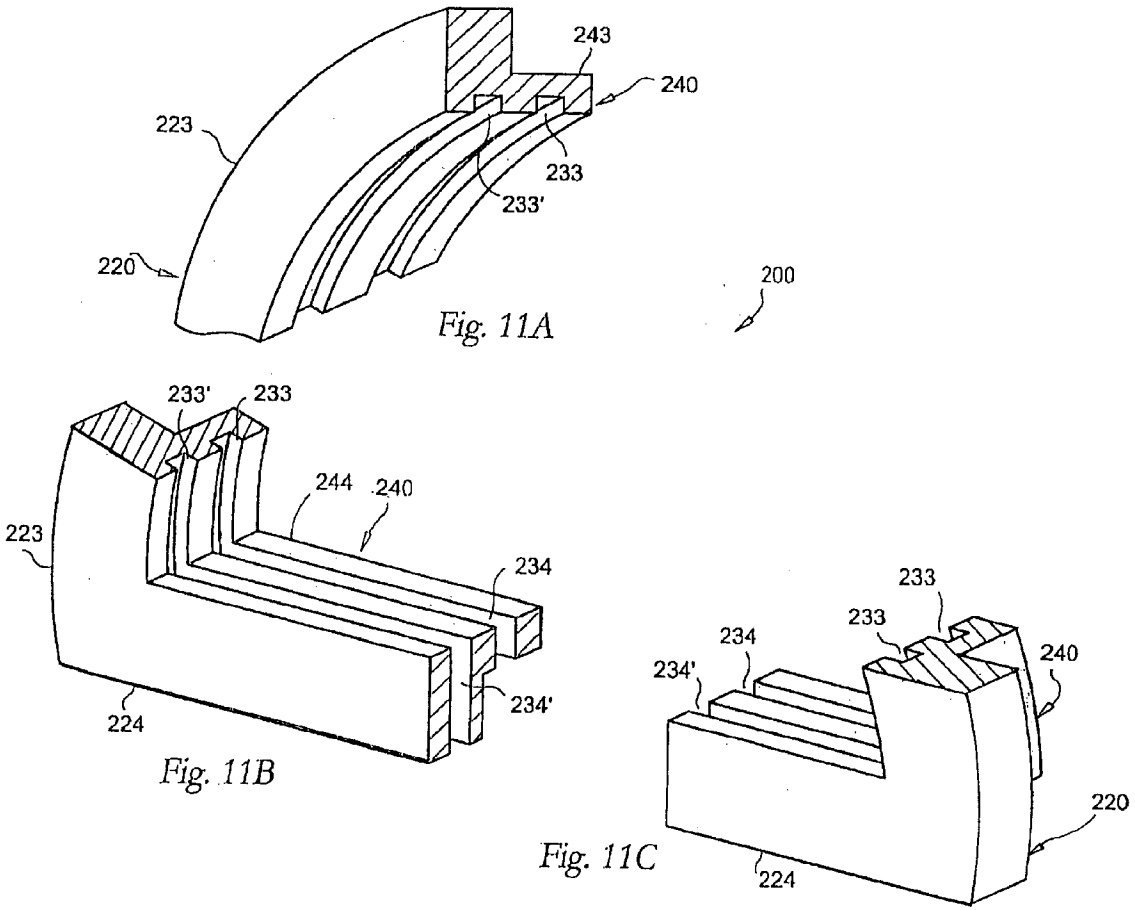
FIG. 11A shows a partial isometric view of the arched elongated member of the embodiment represented in FIG. 9.
FIG. 11B shows a partial isometric view of one of the ends of the straight elongated member where it meets the arched elongated member of the embodiment represented in FIG. 9.
FIG. 11C shows a partial isometric view of the other end of the straight elongated member of the embodiment represented in FIG. 9.

Another embodiment for the present invention is shown as window assembly 200, illustrated in FIGS. 9 and 10, 11A, 11B and 11C, has a substantially half moon shape. Window assembly 200 basically includes outer frame assembly 220, inner frame assembly 240 and transparent members 260 and 260' removably housed within outer and inner frame member 220 and 240, respectively, as best seen in FIG. 10. Outer frame assembly 220 includes straight frame member 224 and arched frame member 223. Arched frame member 223 has a substantially inverted half-moon shape with internal elongated channel 233'. Inner frame assembly 240 includes straight frame member 244 and arched frame member 243. Arched frame member 243 has a substantially inverted half-moon shape with internal elongated channel 233, as best seen in FIGS. 11A, 11B and 11C.

Straight frame members 224 and 244 have substantially the same configuration as in window assembly 100. Frame members 224 and 244 include slots 234 and 234', respectively, as show in FIG. 11C. Slots 234 and 234' have cooperative dimensions to permit transparent members 260 and 260' to go through. Assembly 250 covers assembly 240 including slot 234, thereby preventing the movement of transparent member 160. Assembly 250' covers assembly 220 including slot 234', thereby preventing the movement of transparent member 260'. Assembly 250 and 250' can also include ornamentary features.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A window assembly, comprising:

A) an outer frame assembly having first and second elongated members each including two ends, said first elongated member defining an arch, and said second elongated member being straight, and the ends of said first and second elongated members being cooperatively connected to define a half-moon shape, and defining first outer and inner common and coplanar surfaces;

B) an inner frame assembly having third and fourth elongated members each including two ends, said third elongated member defining an arch, and said fourth elongated member being straight, and the ends of said third and fourth elongated members being cooperatively connected to define a half-moon shape, said inner frame assembly including an outer common and coplanar surface and second inner and outer peripheral edges, said inner frame assembly extending from said first inner common and co-planar surface keeping said first and second inner peripheral edged in alignment thereby defining a window area, and said fourth elongated member including a first longitudinal slot; and C) a first transparent member having cooperative dimensions and including a first arched lateral end and a first straight lateral end with an area slightly larger than said window area and being removably mounted through said first longitudinal slot.

2. The window assembly set forth in claim 1, wherein said third elongated member includes a first channel along said second inner peripheral edge for receiving said first arched lateral end of said first transparent member.

3. The window assembly set forth in claim 2 further including a first ornamentary frame assembly mounted over said inner frame assembly covering said second outer peripheral edges and said first longitudinal slot.

4. The window assembly set forth in claim 3 wherein said second elongated member includes a second longitudinal slot, and further including a second transparent member having cooperative dimensions and including a second arched lateral end and a second straight lateral end with an area slightly larger than said window area and being removably mounted through said second longitudinal slot.

5. The window assembly set forth in claim 4, wherein said first elongated member includes a second channel along said first inner peripheral edge for receiving said second arched lateral end.

* * * * *